US009128434B2

(12) United States Patent
Takahashi et al.

(10) Patent No.: US 9,128,434 B2
(45) Date of Patent: Sep. 8, 2015

(54) FIXING DEVICE AND IMAGE FORMING APPARATUS

(71) Applicant: KYOCERA Document Solutions Inc., Osaka (JP)

(72) Inventors: Hironori Takahashi, Osaka (JP); Motoki Moriguchi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/465,323

(22) Filed: Aug. 21, 2014

(65) Prior Publication Data

US 2015/0078793 A1 Mar. 19, 2015

(30) Foreign Application Priority Data

Sep. 17, 2013 (JP) ..... 2013-191943

(51) Int. Cl.
*G03G 15/20* (2006.01)

(52) U.S. Cl.
CPC ..... *G03G 15/2053* (2013.01); *G03G 15/2025* (2013.01); *G03G 2215/2025* (2013.01); *G03G 2215/2035* (2013.01)

(58) Field of Classification Search
CPC ..... G03G 15/2025; G03G 15/2053; G03G 2215/2025; G03G 2215/2035
USPC ..... 399/122, 320, 329, 335, 336
See application file for complete search history.

(56) References Cited

U.S. PATENT DOCUMENTS

| | | | | |
|---|---|---|---|---|
| 8,160,484 | B2 | 4/2012 | Hasegawa et al. | |
| 8,725,038 | B2 | 5/2014 | Yamaguchi et al. | |
| 2011/0064493 | A1* | 3/2011 | Muramatsu et al. | 399/329 |
| 2014/0072352 | A1* | 3/2014 | Naito et al. | 399/329 |
| 2014/0112691 | A1* | 4/2014 | Nanno et al. | 399/329 |
| 2015/0063883 | A1* | 3/2015 | Nakano | 399/329 |
| 2015/0110530 | A1* | 4/2015 | Uehara et al. | 399/329 |

FOREIGN PATENT DOCUMENTS

| | | | |
|---|---|---|---|
| JP | 2010-096782 | A | 4/2010 |
| JP | 2012-128074 | A | 7/2012 |

* cited by examiner

*Primary Examiner* — Francis Gray
(74) *Attorney, Agent, or Firm* — Studebaker & Brackett PC

(57) ABSTRACT

A fixing device includes a fixing belt, a pressure rotating body, a nip member, a supporting member, a heating source, a heat conducting member and a reflecting member. The pressure rotating body is rotatably arranged outside the fixing belt to come into pressure contact with the fixing belt to form a fixing nip. The nip member is arranged inside the fixing belt to press the fixing belt toward the pressure rotating body. The supporting member supports the nip member. The heating source is arranged inside the fixing belt to emit radiant heat. The heat conducting member is supported by the supporting member in a cantilevered state to come into contact with an inner circumference face of the fixing belt and to absorb the radiant heat. The reflecting member reflects the radiant heat toward the heat conducting member and at least partially comes into contact with the heat conducting member.

20 Claims, 10 Drawing Sheets

FIXING DEVICE AND IMAGE FORMING APPARATUS

INCORPORATION BY REFERENCE

This application is based on and claims the benefit of priority from Japanese Patent application No. 2013-191943 filed on Sep. 17, 2013, the entire contents of which are incorporated herein by reference.

BACKGROUND

The present disclosure relates to a fixing device fixing a toner image on a recording medium and an image forming apparatus including the fixing device.

An electrographic image forming apparatus, such as a copying machine or a printer, includes a fixing device fixing a toner image on a recording medium, such as a sheet. In the fixing device, a "heat roller manner" is widely applied in viewpoints of heat efficiency, safety and others. The heat roller manner is a manner using a pair of rollers to form a fixing nip. On the other hand, a "belt manner" recently attracts attention due to requests of shortening of a warm-up time, energy saving or others. The belt manner is a manner using a fixing belt to form the fixing nip.

For example, there is a fixing device including a fixing belt, a pressure rotating body coming into pressure contact with the fixing belt, a nip member pressing the fixing belt toward a side of the pressure rotating body, a supporting member supporting the nip member and a heating source emitting radiant heat.

In the fixing device with such a configuration, there is a problem that, if the fixing belt is directly heated by the heating source, the temperature of the fixing belt is excessively risen and quality (heat resistance) of grease used between the fixing belt and nip member is deteriorated. In addition, there is a problem that the fixing belt is deformed due to the excessive temperature rise of the fixing belt, and accordingly, contact between a contact type temperature detecting part (a thermistor) and the fixing belt is lost and normal control becomes impossible or a distance between a non-contact type excessive temperature rise preventing device (a thermostat) and the fixing belt is varied to cause unsuitable operation of the excessive temperature rise preventing device.

By contrast, there is a configuration that a heat conducting member coming into contact with an inner circumference face of the fixing belt is heated by the heating source and the fixing belt is heated by heat conduction from the heat conducting member. In this configuration, the radiant heat emitted from the heating source is reflected by a reflecting member.

However, in the above-mentioned configuration, there are possibilities that, when the fixing belt is deformed according to the rotation of the fixing belt, contact failure between the heat conducting member and fixing belt is caused, heat conduction efficiency from the heat conducting member to the fixing belt is deteriorated, and temperature rise rate of the fixing belt is lowered. In addition, there are problems that, if the heat conduction efficiency from the heat conducting member to the fixing belt is deteriorated as mentioned above, a temperature difference between the fixing belt and heat conducting member is increased and the excessive temperature rise (overshoot) of the fixing belt occurs when the rotation of the fixing belt is stopped.

Moreover, in the above-mentioned configuration, there are possibilities that a part of the radiant heat from the heating source is absorbed by the reflecting member, and then, the temperature of the reflecting member is rapidly risen. If the temperature of the reflecting member is thus rapidly risen, there are problems that the temperature of a member supporting the reflecting member is excessively risen to cause deformation of the member and the excessive temperature rise (the overshoot) of the fixing belt occurs by the heat conduction from the reflecting member when the rotation of the fixing belt is stopped.

SUMMARY

In accordance with an embodiment of the present disclosure, a fixing device includes a fixing belt, a pressure rotating body, a nip member, a supporting member, a heating source, a heat conducting member and a reflecting member. The fixing belt is arranged rotatably. The pressure rotating body is arranged outside the fixing belt to come into pressure contact with the fixing belt so as to form a fixing nip, and arranged rotatably. The nip member is arranged inside the fixing belt to press the fixing belt toward a side of the pressure rotating body. The supporting member supports the nip member. The heating source is arranged inside the fixing belt to emit radiant heat. The heat conducting member is supported by the supporting member in a cantilevered state to come into contact with an inner circumference face of the fixing belt and to absorb the radiant heat emitted from the heating source. The reflecting member is configured to reflect the radiant heat emitted from the heating source toward the heat conducting member and to at least partially come into contact with the heat conducting member.

In accordance with an embodiment of the present disclosure, an image forming apparatus includes a fixing device. The fixing device includes a fixing belt, a pressure rotating body, a nip member, a supporting member, a heating source, a heat conducting member and a reflecting member. The fixing belt is arranged rotatably. The pressure rotating body is arranged outside the fixing belt to come into pressure contact with the fixing belt so as to form a fixing nip, and arranged rotatably. The nip member is arranged inside the fixing belt to press the fixing belt toward a side of the pressure rotating body. The supporting member supports the nip member. The heating source is arranged inside the fixing belt to emit radiant heat. The heat conducting member is supported by the supporting member in a cantilevered state to come into contact with an inner circumference face of the fixing belt and to absorb the radiant heat emitted from the heating source. The reflecting member is configured to reflect the radiant heat emitted from the heating source toward the heat conducting member and to at least partially come into contact with the heat conducting member.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
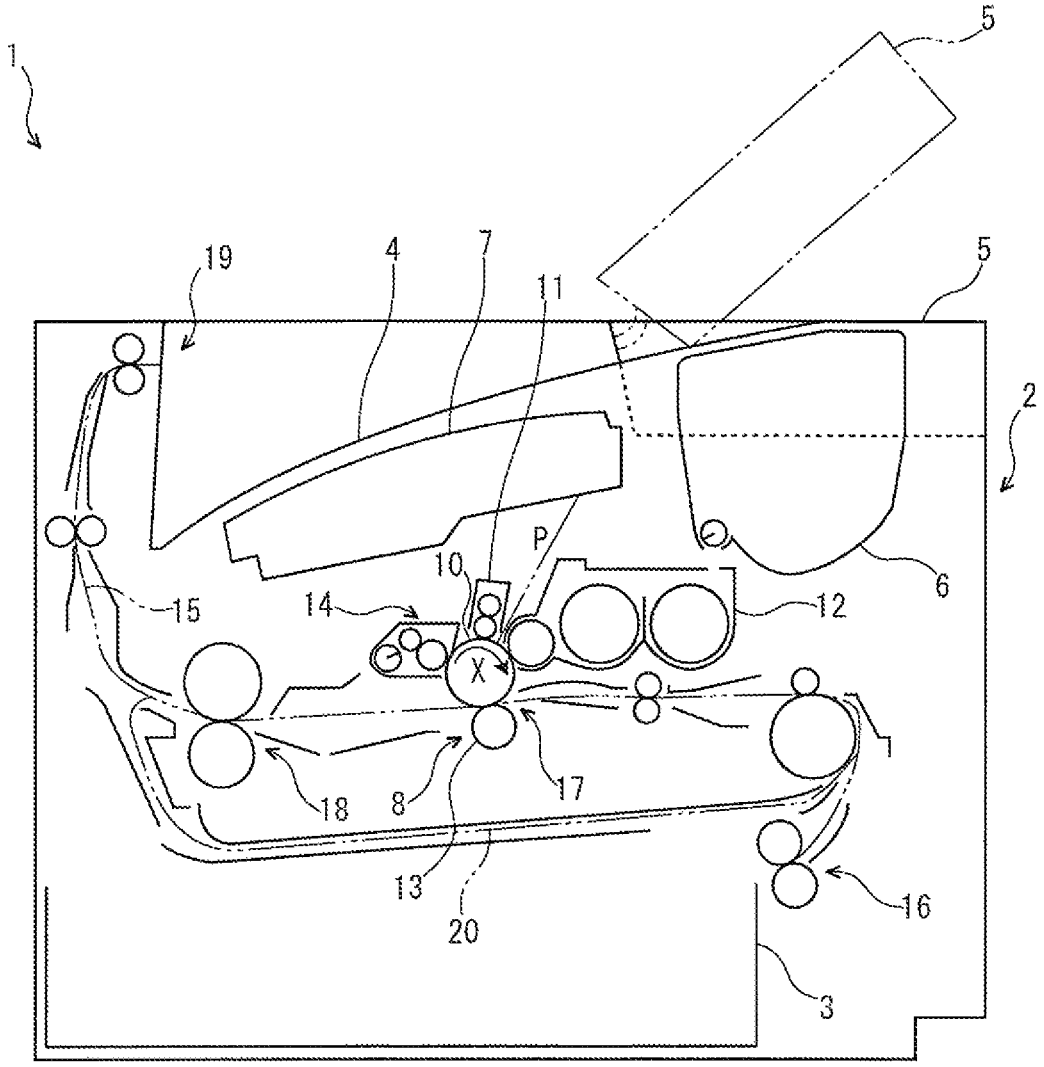
FIG. 1 is a schematic diagram schematically showing a printer according to an embodiment of the present disclosure.

First, with reference to FIG. 1, the entire structure of a printer 1 (an image forming apparatus) will be described.

The printer 1 includes a box-like formed printer main body 2. In a lower part of the printer main body 2, a sheet feeding cartridge 3 storing sheets (recording mediums) is installed and, in a top face of the printer main body 2, an ejected sheet tray 4 is formed. To the top face of the printer main body 2, an upper cover 5 is openably/closably attached at a lateral side of the ejected sheet tray 4 and, below the upper cover 5, a toner container 6 is installed.

In an upper part of the printer main body 2, an exposure device 7 composed of a laser scanning unit (LSU) is located below the ejected sheet tray 4. Below the exposure device 7, an image forming part 8 is arranged. In the image forming part 8, a photosensitive drum 10 as an image carrier is rotatably arranged. Around the photosensitive drum 10, a charger 11, a development device 12, a transfer roller 13 and a cleaning device 14 are located along a rotating direction (refer to an arrow X in FIG. 1) of the photosensitive drum 10.

Inside the printer main body 2, a conveying path 15 for the sheet is arranged. At an upstream end in the conveying path 15, a sheet feeder 16 is positioned. At an intermediate stream part in the conveying path 15, a transferring part 17 composed of the photosensitive drum 10 and transfer roller 13 is positioned. At a downstream part in the conveying path 15, a fixing device 18 is positioned. At a downstream end in the conveying path 15, a sheet ejecting part 19 is positioned. Below the conveying path 15, an inversion path 20 for duplex printing is arranged.

Next, the operation of forming an image by the printer 1 having such a configuration will be described.

When the power is supplied to the printer 1, various parameters are initialized and initial determination, such as temperature determination of the fixing device 18, is carried out. Subsequently, in the printer 1, when image data is inputted and a printing start is directed from a computer or the like connected with the printer 1, image forming operation is carried out as follows.

First, the surface of the photosensitive drum 10 is electrically charged by the charger 11. Then, exposure corresponding to the image data on the photosensitive drum 10 is carried out by a laser light (refer to a two-dot chain line P in FIG. 1) from the exposure device 7, thereby forming an electrostatic latent image on the surface of the photosensitive drum 10. Subsequently, the development device 12 develops the electrostatic latent image to a toner image by a toner (a developer).

On the other hand, a sheet fed from the sheet feeding cartridge 3 by the sheet feeder 16 is conveyed to the transferring part 17 in a suitable timing for the above-mentioned image forming operation, and then, the toner image on the photosensitive drum 10 is transferred onto the sheet in the transferring part 17. The sheet with the transferred toner image is conveyed to a downstream side in the conveying path 15 to be inserted to the fixing device 18, and then, the toner image is fixed on the sheet in the fixing device 18. The sheet with the fixed toner image is ejected from the sheet ejecting part 19 to the ejected sheet tray 4. The toner remained on the photosensitive drum 10 is collected by the cleaning device 14.

Next, the fixing device 18 will be described in detail. Hereinafter, it will be described so that the front side of the fixing device 18 is positioned at the near side of FIG. 2, for convenience of explanation. An arrow Y in FIG. 2 indicates a conveying direction of the sheet. An arrow Fr suitably indicated in each figure indicates the front side of the fixing device 18.

Figure 2:
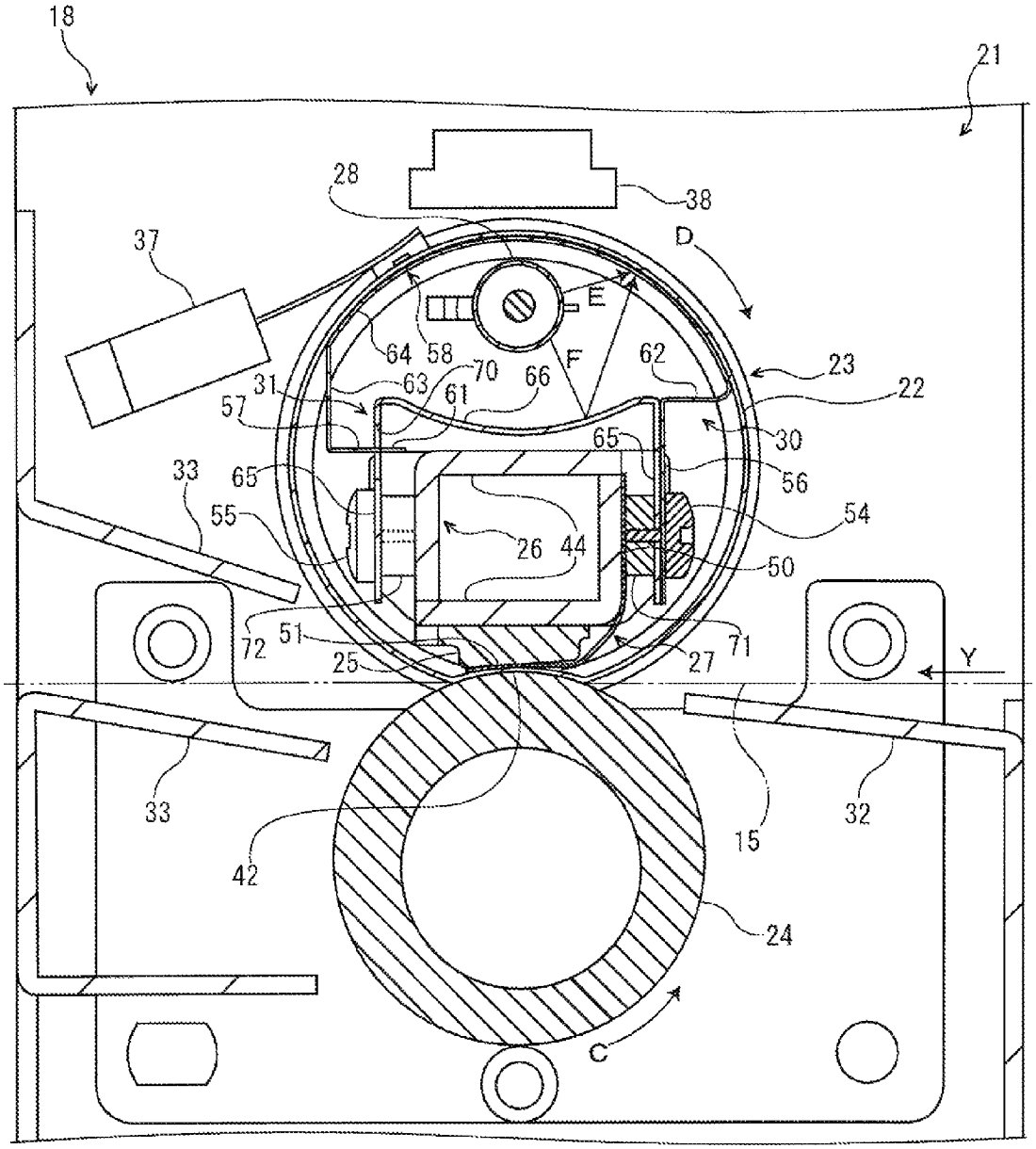
FIG. 2 is a sectional view showing a fixing device in the printer according to the embodiment of the present disclosure.

As shown in FIG. 2, the fixing device 18 mainly includes a box-like formed fixing frame 21, a fixing belt 22, a pair of bearings 23 (in FIG. 2, a rear bearing 23 is shown), a press roller 24 (a pressure rotating body), a nip member 25, a supporting member 26, a slide contact member 27, a heater 28 (a heating source), a heat conducting member 30 and a reflecting member 31. The fixing belt 22 is installed in an upper part of the fixing frame 21. The pair of the bearings 23 are respectively positioned at both front and rear end sides of the fixing belt 22. The press roller 24 is installed in a lower part of the fixing frame 21. The nip member 25 is positioned inside the fixing belt 22. The supporting member 26 is positioned above the nip member 25 inside the fixing belt 22. The slide contact member 27 is positioned from a lower side to a right side of the nip member 25 and supporting member 26 inside the fixing belt 22. The heater 28 is positioned above the supporting member 26 inside the fixing belt 22. The heat conducting member 30 is positioned from an upper side to both left and right sides of the heater 28 inside the fixing belt 22. The reflecting member 31 is positioned below the heater 28 inside the fixing belt 22.

In a right side part of the fixing frame 21, an insertion guide 32 is positioned below the conveying path 15 for the sheet. In a left side part of the fixing frame 21, ejection guides 33 are positioned both above and below the conveying path 15 for the sheet.

Figure 3:
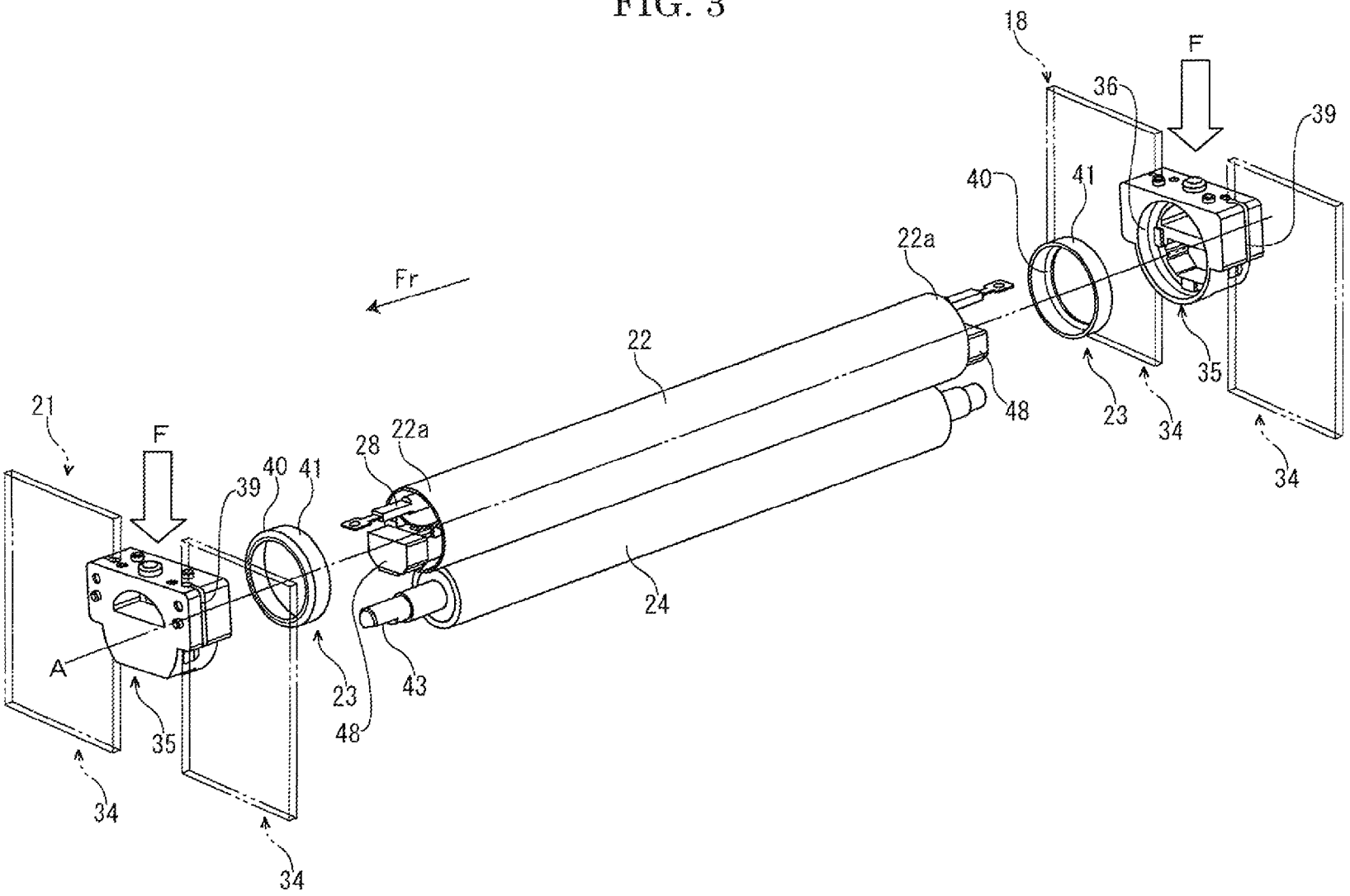
FIG. 3 is an exploded perspective view showing the fixing device in the printer according to the embodiment of the present disclosure.

As shown in FIG. 3, in both front and rear end parts of the fixing frame 21, pairs of guide walls 34 are arranged so that the guide walls 34 in each pair are faced to each other at a predetermined interval. Between the guide walls 34 in each pair, a housing 35 is positioned. In both left and right side parts of each housing 35, guide grooves 39 are formed in upward and downward directions. The guide grooves 39 are engaged with inner edge parts of the guide walls 34 in each pair. Thereby, each housing 35 is supported slidably in the upward and downward directions by each pair of the guide walls 34. Each housing 35 is biased downwardly (refer to an arrow F in FIG. 3) by a biasing member (not shown) composed of a coil spring or the like. In an inside face of each housing 35, an installation concave part 36 is arranged.

The fixing belt 22 is formed in a roughly cylindrical shape elongated in forward and backward directions. The fixing belt 22 has flexibility and is endless in a circumference direction. The fixing belt 22 is composed of, for example, a base material layer, an elastic layer provided around the base material layer and a release layer covering the elastic layer. The base material layer of the fixing belt 22 is made of, for example, metal, such as steel special use stainless (SUS). Alternatively, the base material layer of the fixing belt 22 may be made of, for example, resin, such as polyimide (PI). The base material layer of the fixing belt 22 has, for example, an internal diameter ϕ of 30 mm and a thickness of 30 μm. The elastic layer of the fixing belt 22 is made of, for example, a silicone rubber. The elastic layer of the fixing belt 22 has, for example, a thickness of 200 μm. The release layer of the fixing belt 22 is made of, for example, a perfluoro alkoxy alkane (PFA) tube. The release layer of the fixing belt 22 has, for example, a thickness of 30 μm. Each figure shows the respective layers (the base material layer, elastic layer and release layer) of the fixing belt 22 without distinguishing.

To the inner circumference face of the fixing belt 22, a fluorine-based resin coating is applied. This coating has, for example, a thickness of 10 μm. On the inner circumference face of the fixing belt 22, grease (lubricant) is applied. The grease is, for example, fluorine grease, a silicone oil or the like.

As shown in FIG. 2, at a left upper side of the fixing belt 22, a contact type thermistor 37 (a temperature detecting part) detecting the temperature of the fixing belt 22 is arranged. At an upper side of the fixing belt 22, a non-contact type thermostat 38 (an excessive temperature rise preventing device) preventing an excessive temperature rise of the fixing belt 22 is arranged.

As shown in FIG. 3, each bearing 23 is formed in a cylindrical shape. The bearings 23 are attached to both front and rear end parts 22*a* of the fixing belt 22. Each bearing 23 is installed into the installation concave part 36 of each housing 35 in a rotatable state. Thereby, the fixing belt 22 is rotatably supported by the each housing 35 via each bearing 23 and the fixing belt 22 is configured so as to be capable of rotating around a rotating axis A extending in the forward and backward directions. That is, in the embodiment, the forward and backward directions equal to a rotating axis direction of the fixing belt 22.

Figure 4:
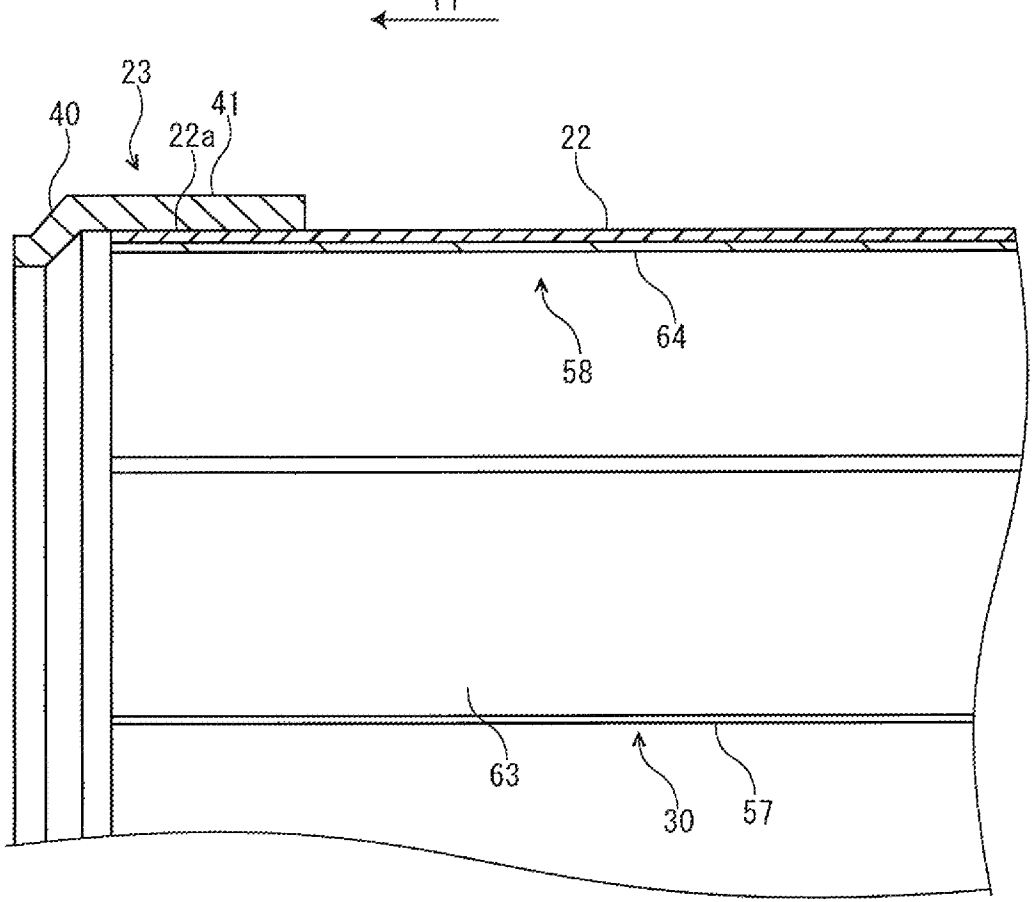
FIG. 4 is a sectional view showing a front end part of a fixing belt and the periphery in the fixing device of the printer according to the embodiment of the present disclosure.

As shown in FIG. 4, each bearing 23 has a meander regulating part 40 and a flange part 41 extending from an end part at an external diameter side of the meander regulating part 40 to the inside in the forward and backward directions. The meander regulating part 40 is inclined toward an internal diameter side to the outside in the forward and backward directions. The respective meander regulating parts 40 of the bearings 23 are positioned at the outside in the forward and backward directions of the front and rear end parts 22*a* (in FIG. 4, the front end part 22*a* is shown) of the fixing belt 22 to regulate a meandering (a deviation in the forward and backward directions) of the fixing belt 22. The flange parts 41 of the bearings 23 cover an external diameter side of the front and rear end parts 22*a* of the fixing belt 22.

The press roller 24 (refer to FIG. 2 and other figures) is formed in a roughly cylindrical shape elongated in the forward and backward directions. The press roller 24 is composed of, for example, a cylindrical core member, an elastic layer provided around the core member and a release layer covering the elastic layer. The core member of the press roller 24 is made of, for example, metal, such as iron. The core member of the press roller 24 has, for example, an external diameter ϕ of 18 mm. The elastic layer of the press roller 24 is made of, for example, a silicone rubber. The elastic layer of the press roller 24 has, for example, a thickness of 3.5 mm. The release layer of the press roller 24 is made of, for example, a perfluoro alkoxy alkane (PFA) tube. The release layer of the press roller 24 has, for example, a thickness of 50 μm. Each figure shows the respective layers (the core member, elastic layer and release layer) of the press roller 24 without distinguishing.

The press roller 24 is positioned below (outside) the fixing belt 22. The press roller 24 comes into pressure contact with the fixing belt 22 and, between the fixing belt 22 and press roller 24, a fixing nip 42 is formed. The press roller 24 is rotatably supported by the fixing frame 21. As shown in FIG. 3 and other figures, in a front end part of the press roller 24, a gear fixing part 43 is arranged. To the gear fixing part 43, a drive gear (not shown) is fixed. The drive gear is connected to a drive source (not shown) composed of a motor or the like.

The nip member 25 (refer to FIG. 2 and other figures) is formed in a plate shape elongated in the forward and backward directions. The nip member 25 is made of, for example, a heat resistant resin, such as liquid crystal polymer (LCP). A lower face of the nip member 25 is inclined toward a lower side (a side of the press roller 24) from the right side (an upstream side in the conveying direction of the sheet) to the left side (a downstream side in the conveying direction of the sheet). The lower face of the nip member 25 presses the fixing belt 22 to the lower side (the side of the press roller 24).

The supporting member 26 (refer to FIG. 2 and other figures) is formed in a shape elongated in the forward and backward directions. The supporting member 26 is formed by combining a pair of stays 44 with an L-shaped section and formed in a hollow square shaped section. The pair of the stays 44 are made of, for example, sheet metal, such as galvanized steel sheet (e.g. SECC: Steel Electrolytic Cold Commercial). The pair of the stays 44 has, for example, a thickness of 1.6 mm. Onto a lower face of the supporting member 26, an upper face of the nip member 25 is fixed. Thereby, the nip member 25 is supported by the supporting member 26 and a warp (deformation due to a fixing load) of the nip member 25 is restrained.

Figure 5:
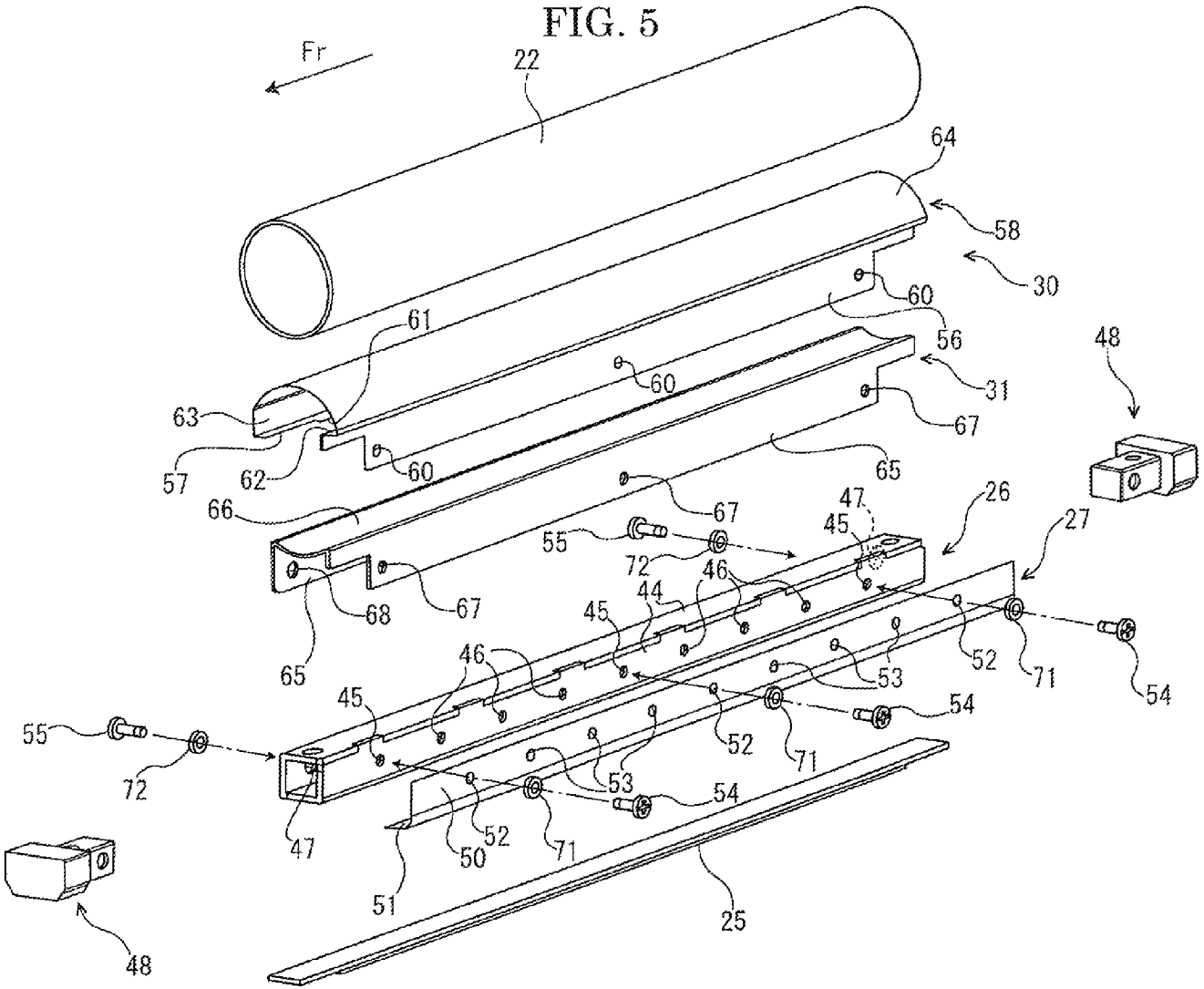
FIG. 5 is an exploded perspective view showing the fixing belt and the peripheral members in the fixing device of the printer according to the embodiment of the present disclosure.

As shown in FIG. 5, in a front part, a rear part and a center part in the forward and backward directions of a right side face (a lateral side face at the upstream side in the conveying direction of the sheet) of the supporting member 26, upstream side hole parts 45 are respectively formed. In the right side face of the supporting member 26, three reinforcement hole parts 46 are formed at intervals each between the adjacent upstream side hole parts 45. In a front part and a rear part of a left side face (a lateral side face at the downstream side in the conveying direction of the sheet) of the supporting member 26, downstream side hole parts 47 are respectively formed.

To both front and rear end parts of the supporting member 26, holding members 48 are respectively attached. Each holding member 48 is made of, for example, metal, such as steel special use stainless (SUS), or a heat resistant resin, such as liquid crystal polymer (LCP). Respective inside parts in the forward and backward directions of the holding members 48 are inserted into the front and rear end parts of the supporting member 26. Each holding member 48 is supported by each housing 35 (refer to FIG. 3).

The slide contact member 27 (refer to FIG. 2 and other figures) is formed in a sheet shape. The slide contact member 27 is made of, for example, a fluorine-based resin, such as polytetrafluoroethylene (PTFE). The slide contact member 27 is interposed between the fixing belt 22 and nip member 25. The slide contact member 27 has an attachment part 50 arranged in a roughly vertical posture and a slide contact part 51 bent from a lower end part of the attachment part 50 to the left side (the downstream side in the conveying direction of the sheet).

As shown in FIG. 5, in a front part, a rear part and a center part in the forward and backward directions of the attachment part 50 of the slide contact member 27, attachment holes 52 are respectively formed. In the attachment part 50, three reinforcement holes 53 are formed at intervals each between the adjacent attachment holes 52. Into each attachment hole 52 and each upstream side hole part 45 of the supporting member 26, a fastening pin 54, such as a screw, is inserted and, into each reinforcement hole 53 and each reinforcement hole part 46 of the supporting member 26, a reinforcement fastening pin (not shown), such as a reinforcement screw, is inserted, and thereby, the attachment part 50 is attached to the right side face of the supporting member 26.

As shown in FIG. 2, the slide contact part 51 of the slide contact member 27 comes into contact with the inner circumference face of the fixing belt 22. Thereby, slidability of the fixing belt 22 is improved.

The heater 28 is composed of, for example, a halogen heater. The heater 28 is configured to generate heat by energization and to emit radiant heat (radiant light).

The heat conducting member 30 is formed in a shape elongated in the forward and backward directions. The heat conducting member 30 is made of, for example, resilient metal, such as steel special use stainless (SUS). The heat conducting member 30 has a thickness of 0.1 mm to 0.3 mm. Onto an inner circumference face (a face facing to the heater 28) of the heat conducting member 30, a black coating improving heat absorptivity is applied.

The heat conducting member 30 has a fixed end part 56, a free end part 57 and a connecting part 58. The fixed end part 56 is arranged at the right side (at the upstream side in the conveying direction of the sheet) of the supporting member 26. The free end part 57 is arranged at the left side (at the downstream side in the conveying direction of the sheet) of the supporting member 26. The connecting part 58 connects the fixed end part 56 and free end part 57.

Figure 6:
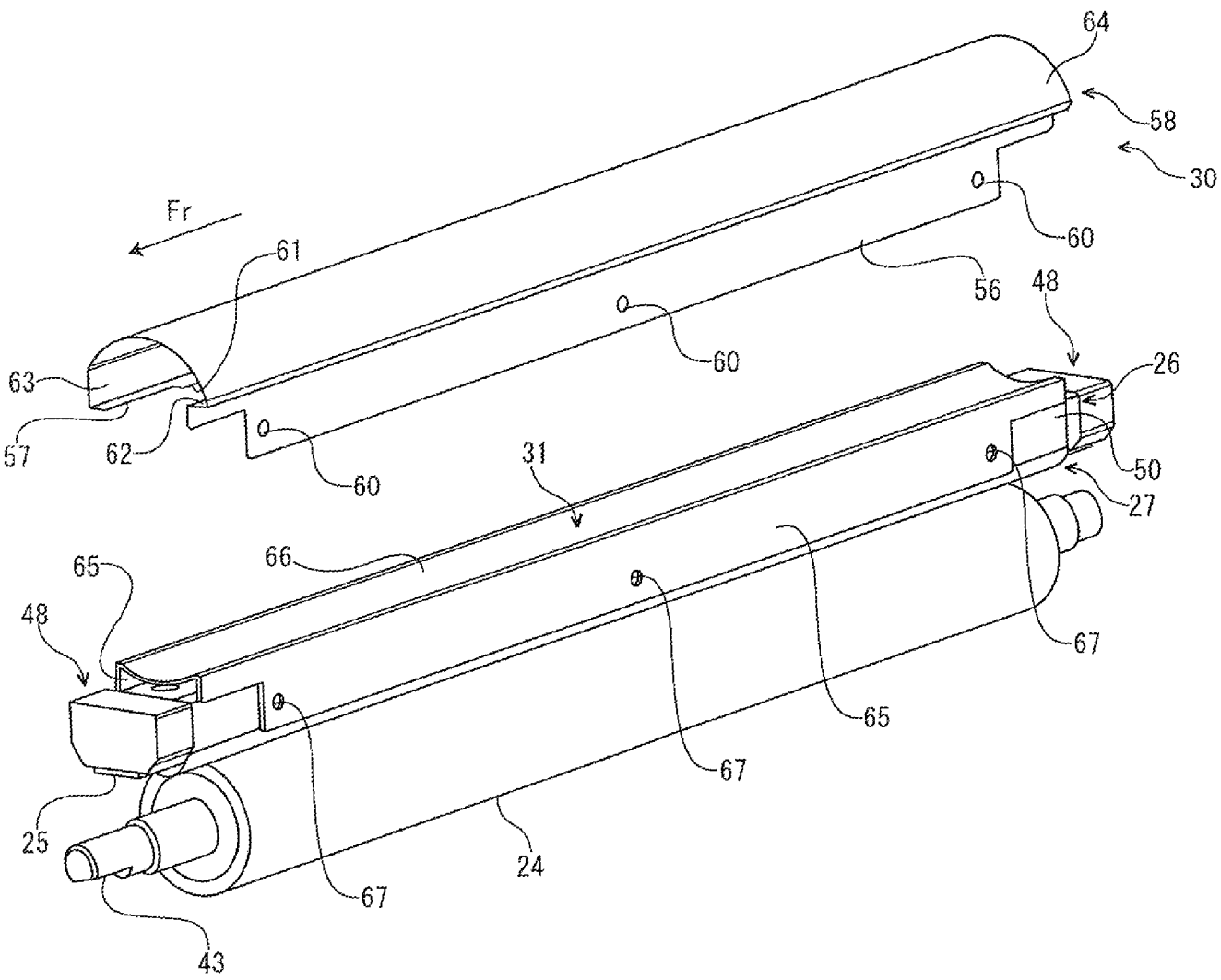
FIG. 6 is a perspective view showing the fixing device as viewed from the right front side, in a condition where a heat conducting member and a reflecting member are separated from each other, in the printer according to the embodiment of the present disclosure.
Figure 7:
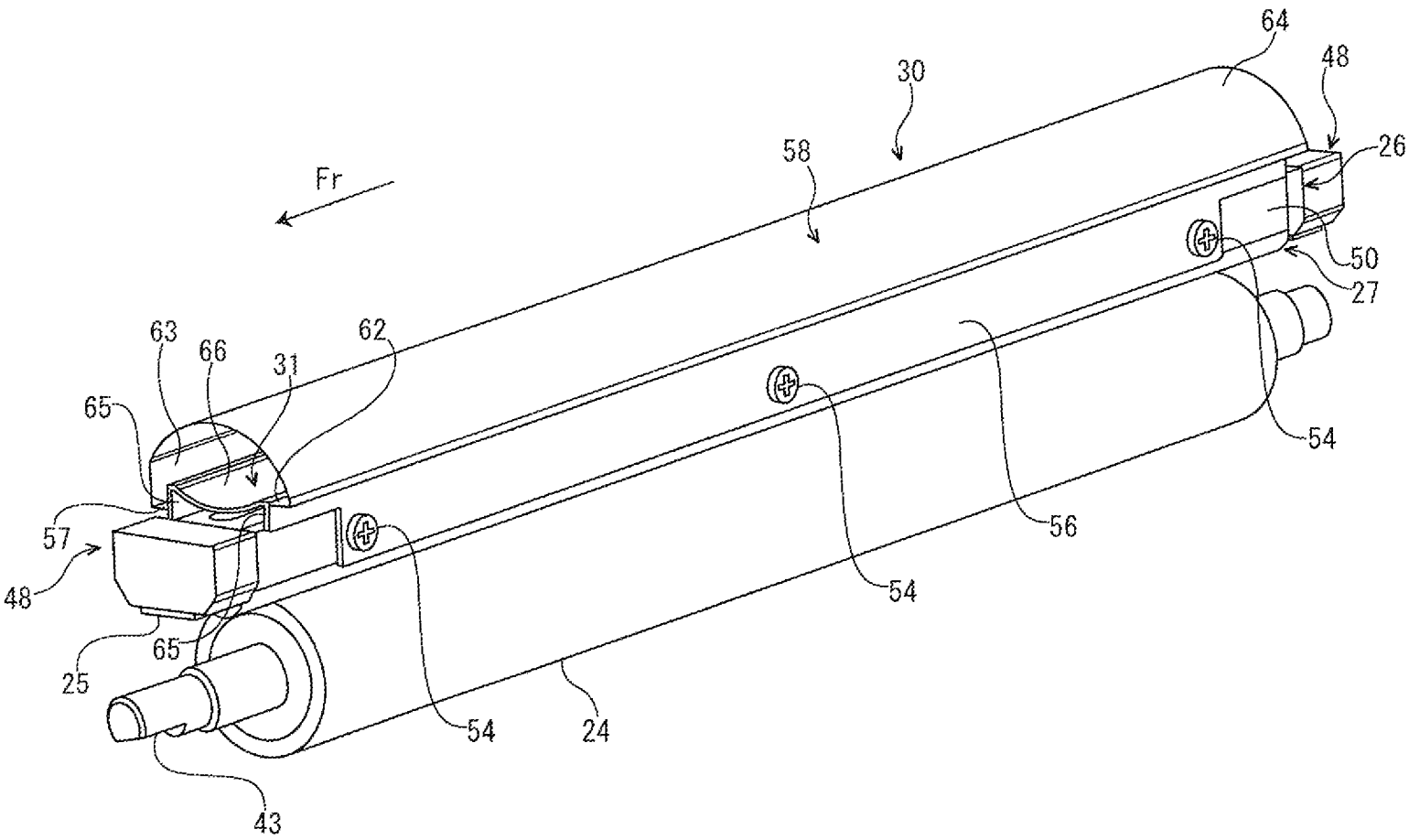
FIG. 7 is a perspective view showing the fixing device as viewed from the right front side, in a condition where the heat conducting member and reflecting member come into contact with each other, in the printer according to the embodiment of the present disclosure.

The fixed end part 56 of the heat conducting member 30 is arranged in a roughly vertical posture. Between the fixed end part 56 and the right side face of the supporting member 26, the attachment part 50 of the slide contact member 27 is interposed. As shown in FIG. 6 and other figures, in a front part, a rear part and a center part in the forward and backward directions of the fixed end part 56, fixation holes 60 are respectively formed. Into each fixation hole 60 and each upstream side hole part 45 of the supporting member 26, the above-mentioned fastening pin 54 is inserted, and thereby, the fixed end part 56 is fixed to the right side face of the supporting member 26 (refer to FIG. 7). Thereby, the heat conducting member 30 is supported by the supporting member 26 in a cantilevered state.

Figure 8:
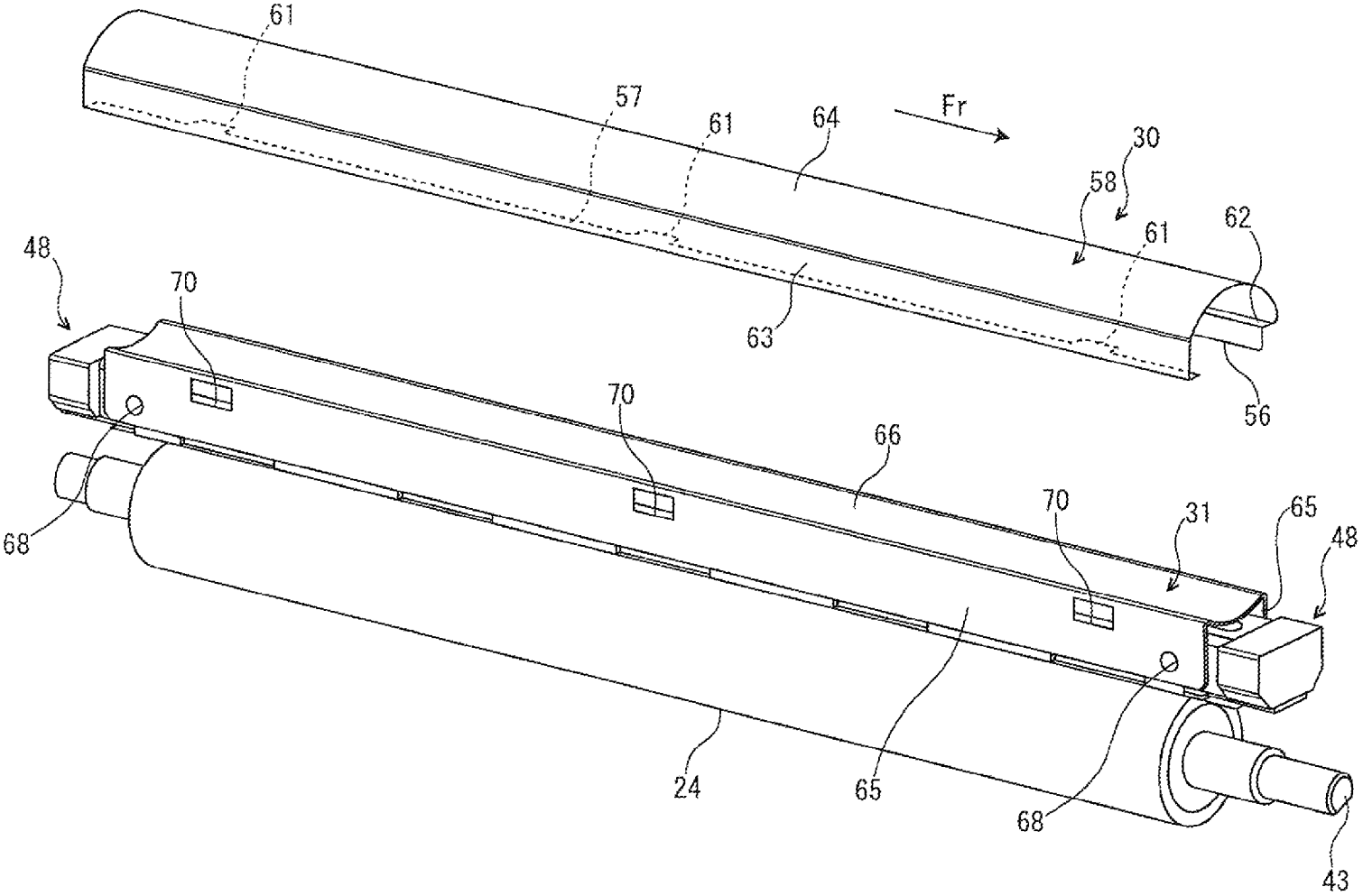
FIG. 8 is a perspective view showing the fixing device as viewed from the left front side, in a condition where the heat conducting member and reflecting member are separated from each other, in the printer according to the embodiment of the present disclosure.
Figure 9:
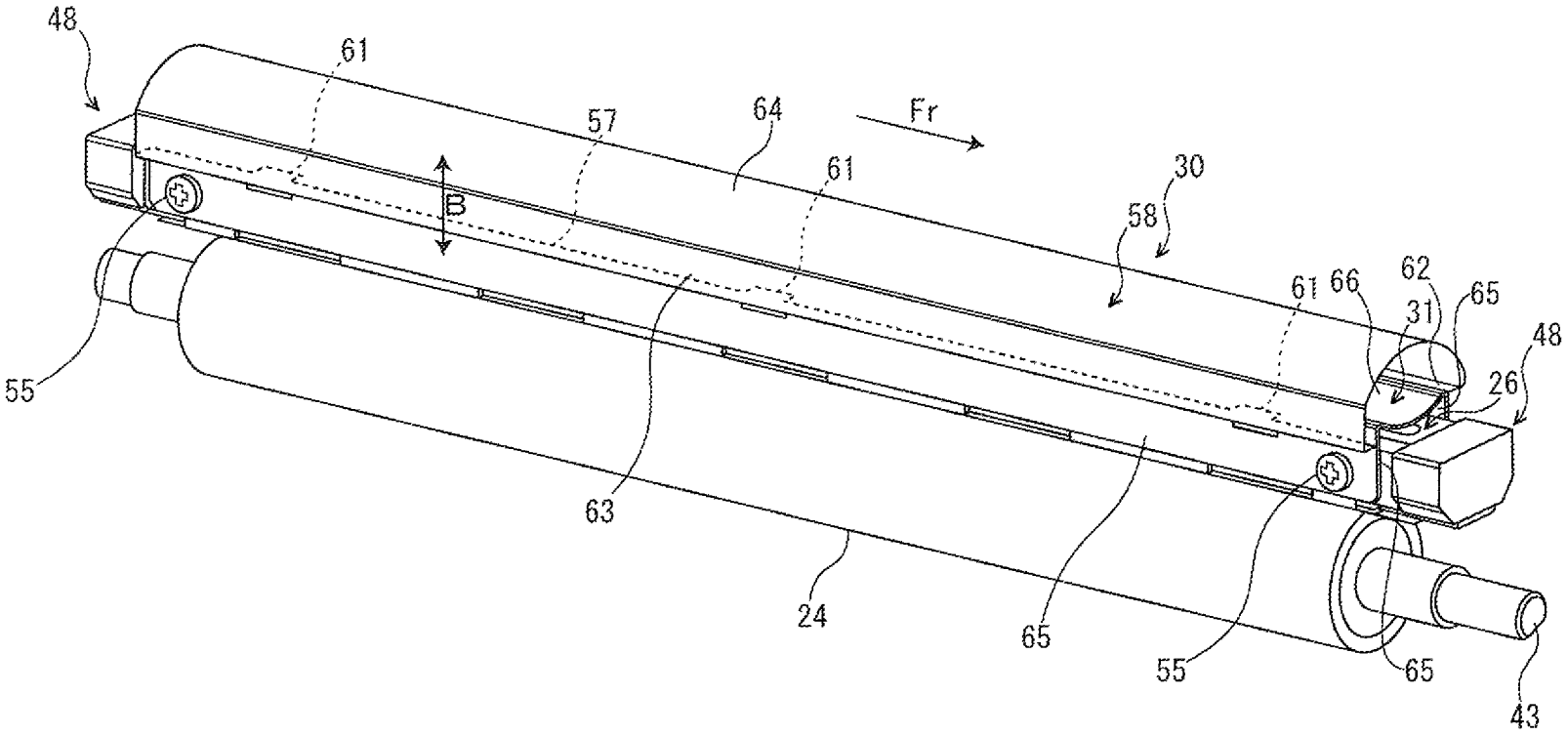
FIG. 9 is a perspective view showing the fixing device as viewed from the left front side, in a condition where the heat conducting member and reflecting member come into contact with each other, in the printer according to the embodiment of the present disclosure.

As shown in FIG. 8 and other figures, the free end part 57 of the heat conducting member 30 is arranged in a roughly horizontal posture. In a front part, a rear part and a center part in the forward and backward directions of the free end part 57, insertion pieces 61 extending to the right side (an internal diameter side of the fixing belt 22) are arranged. The free end part 57 is not fixed to the supporting member 26 and arranged movably in the upward and downward directions with respect to the supporting member 26 (refer to an arrow B in FIG. 9).

As shown in FIG. 2, the connecting part 58 of the heat conducting member 30 has a horizontal plate part 62, a vertical plate part 63 and a curved plate part 64. The horizontal plate part 62 is bent from an upper end of the fixed end part 56 to the right side. The vertical plate part 63 is bent upwardly from a left end of the free end part 57. The curved plate part 64 connects the horizontal plate part 62 and vertical plate part 63. The curved plate part 64 is curved toward the upper side (a side separating from the fixing nip 42) in an arc shape. The curved plate part 64 comes into contact with the inner circumference face of the fixing belt 22. As shown in FIG. 4, between the curved plate part 64 and flange part 41 of each bearing 23, the front or rear end part 22*a* (in FIG. 4, the front end part 22*a* is shown) of the fixing belt 22 is interposed.

The reflecting member 31 (refer to FIG. 2 and other figures) is formed in a shape elongated in the forward and backward directions. The reflecting member 31 is made of, for example, metal, such as bright aluminum. The reflecting member 31 has, for example, a thickness of 0.5 mm.

The reflecting member 31 has a pair of fixed plates 65 respectively arranged at the right side and left side (at the upstream side and downstream side in the conveying direction of the sheet) of the supporting member 26 and a connecting plate 66 connecting the pair of the fixed plates 65.

As shown in FIG. 6 and other figures, each fixed plate 65 of the reflecting member 31 is arranged in a roughly vertical posture. In a front part, a rear part and a center part in the forward and backward directions of the right fixed plate 65, fixing holes 67 are respectively formed. Into each fixing hole 67 and each upstream side hole part 45 of the supporting member 26, the above-mentioned fastening pin 54 is inserted, and thereby, the right fixed plate 65 is fixed to the right side face of the supporting member 26 (refer to FIG. 7). As shown in FIG. 8 and other figures, in a front part and a rear part of the left fixed plate 65, fixing holes 68 are respectively formed. Into each fixing hole 68 and each downstream side hole part 47 of the supporting member 26, a fastening pin 55, such as a screw, is inserted, and thereby, the left fixed plate 65 is fixed to the left side face of the supporting member 26 (refer to FIG. 9). By the above-mentioned configuration, the reflecting member 31 is supported by the supporting member 26.

As shown in FIG. 8, in the front part and rear part and a center part in the forward and backward directions of the left fixed plate 65 of the reflecting member 31, insertion holes 70 are respectively formed. Into each insertion hole 70, each insertion piece 61 arranged in the free end part 57 of the heat conducting member 30 is movably inserted (refer to FIG. 2).

As shown in FIG. 2, between the right fixed plate 65 of the reflecting member 31 and right side face of the supporting member 26, the attachment part 50 of the slide contact member 27 is interposed. A right face of the right fixed plate 65 comes into contact with a left face of the fixed end part 56 of the heat conducting member 30. Between the right fixed plate 65 and attachment part 50 of the slide contact member 27, first heat insulating spacers 71 are interposed. The first heat insulating spacer 71 is mounted around an outer circumference of the fastening pin 54. Between the left fixed plate 65 and left side face of the supporting member 26, second heat insulating spacers 72 are interposed. The second heat insulating spacer 72 is mounted around an outer circumference of the fastening pin 55.

The connecting plate 66 of the reflecting member 31 is curved toward the lower side (a side approaching to the fixing nip 42) in an arc shape. The connecting plate 66 is arranged so as to cover a part of the heater 28 not covered by the heat conducting member 30 in a circumferential direction. The connecting plate 66 faces to the curved plate part 64 of the heat conducting member 30 and, between the curved plate part 64 of the heat conducting member 30 and connecting plate 66, the heater 28 is positioned.

In the fixing device 18 configured as mentioned above, in order to fix the toner image onto the sheet, as indicated by an arrow C in FIG. 2, the drive source (not shown) works to rotate the press roller 24. When the press roller 24 is thus rotated, as indicated by an arrow D in FIG. 2, the fixing belt 22, with which the press roller 24 comes into pressure contact, is co-rotated in an opposite direction to the press roller 24. When the fixing belt 22 is thus rotated, each bearing 23 is co-rotated with the fixing belt 22 by friction force between the fixing belt 22 and flange part 41 of each bearing 23, and then, each bearing 23 slides with respect to each housing 35.

Moreover, in order to fix the toner image onto the sheet, the heater 28 is activated (lighted). When the heater is thus activated, the heater 28 emits the radiant heat. The radiant heat emitted from the heater 28 to the heat conducting member 30 directly reaches, as indicated by an arrow E in FIG. 2, the inside face of the heat conducting member 30 and is absorbed by the inside face of the heat conducting member 30. The radiant heat emitted from the heater 28 to the supporting member 26 is reflected, as indicated by an arrow F in FIG. 2, toward the heat conducting member 30 by the connecting plate 66 of the reflecting member 31, reaches the inside face of the heat conducting member 30 and is absorbed by the inside face of the heat conducting member 30. In accordance with the above-mentioned action, the heat conducting member 30 is heated, and simultaneously, the fixing belt 22 is heated by heat conduction from the heat conducting member 30. In such a condition, when the sheet is passed through the fixing nip 42, the toner image is heated and melted, and accordingly, the toner image is fixed onto the sheet.

Figure 10:
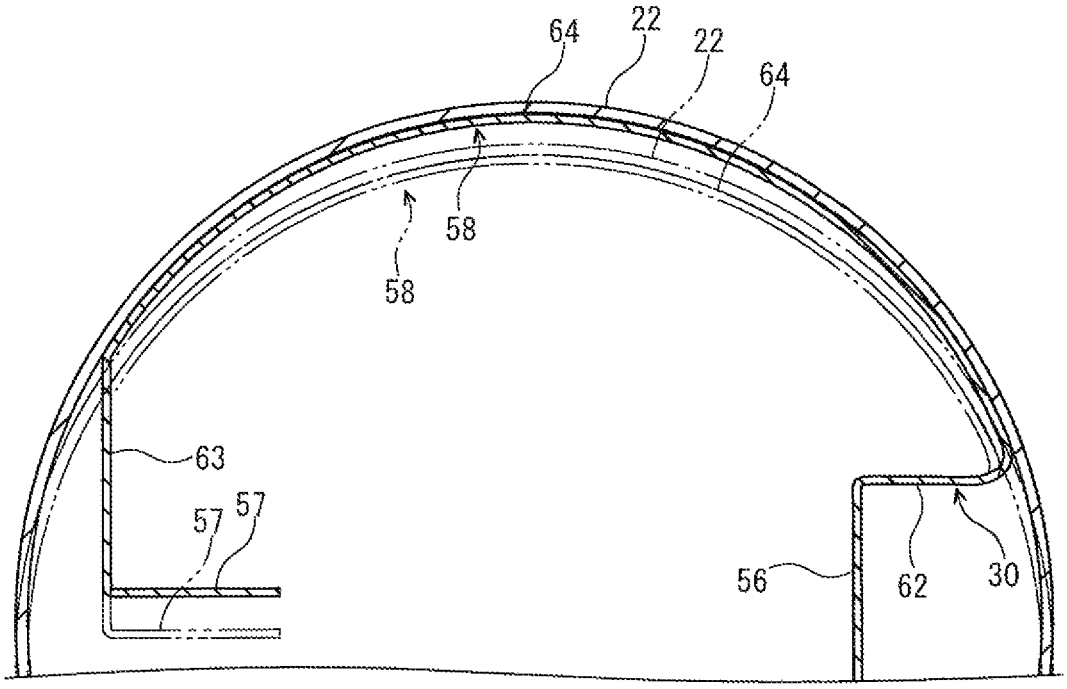
FIG. 10 is a sectional view showing the fixing belt and heat conducting member in the fixing device of the printer according to the embodiment of the present disclosure.

When the toner image is thus fixed onto the sheet, the fixing belt 22 is deformed according to the rotation of the fixing belt 22 (refer to a two-dot chain line in FIG. 10). When the fixing belt 22 is thus deformed, there are possibilities that contact failure between the heat conducting member 30 and fixing belt 22 may be caused and heat conduction efficiency from the heat conducting member 30 to the fixing belt 22 may be deteriorated.

However, in the embodiment, since the heat conducting member 30 is supported by the supporting member 26 in the cantilevered state, when the fixing belt 22 is deformed according to the rotation of the fixing belt 22, it is possible to deform a left side portion (a portion at the downstream side in the conveying direction of the sheet) of the heat conducting member 30 (refer to a two-dot chain line in FIG. 10) in accordance with the deformation of the fixing belt 22. Therefore, it is possible to make the heat conducting member 30 securely come into contact with the fixing belt 22, and then, to improve the heat conduction efficiency from the heat conducting member 30 to the fixing belt 22. According to this, it is possible to increase temperature rise rate of the fixing belt 22, and simultaneously, to decrease a temperature difference between the fixing belt 22 and heat conducting member 30, and accordingly, to restrain the excessive temperature rise (overshoot) of the fixing belt 22 when the rotation of the fixing belt 22 is stopped. Particularly in the embodiment, since the heat conducting member 30 is made of resilient material (metal), it is possible to deform the heat conducting member 30 easily in accordance with the deformation of the fixing belt 22.

Since the reflecting member 31 partially comes into contact with the heat conducting member 30, it is possible to conduct the heat of the reflecting member 31 to the fixing belt 22 via the heat conducting member 30 when the temperature of the reflecting member 31 becomes higher than the temperature of the heat conducting member 30. Therefore, it is possible to restrain temperature rise of the reflecting member 31, and accordingly, to restrain the temperature of the supporting member 26 and holding members 48 from excessively rising and to restrain the temperature of the fixing belt 22 from excessively rising (overshooting) in accordance with heat conduction from the reflecting member 31 when the rotation of the fixing belt 22 is stopped.

Particularly in the embodiment, the right fixed plate 65 of the reflecting member 31 partially comes into contact with the fixed end part 56 of the heat conducting member 30. By applying such a configuration, it is possible to secure the contact between the reflecting member 31 and heat conducting member 30 in the fixed end part 56 having a relatively small deformation amount within the heat conducting member 30 and to stabilize the contact state of the reflecting member 31 and heat conducting member 30.

The free end part 57 of the heat conducting member 30 has the insertion pieces 61 extending to the right side (the internal diameter side of the fixing belt 22) and the left fixed plate 65 of the reflecting member 31 has the insertion holes 70 into which the insertion pieces 61 are movably inserted. By applying such a configuration, it is possible to restrain the left side portion (the portion at the downstream side in the conveying direction of the sheet) of the heat conducting member 30 from excessively deforming in a case where large force is applied to the heat conducting member 30 during a jam process or the like.

Since the heater 28 is positioned between the curved plate part 64 of the heat conducting member 30 and connecting plate 66 of the reflecting member 31, it is possible to make the reflecting member 31 efficiently reflect the radiant heat emitted from the heater 28 toward the heat conducting member 30.

Since the both front and rear end parts 22*a* of the fixing belt 22 are interposed between the curved plate part 64 of the heat conducting member 30 and flange part of each bearing 23, it is possible to regulate looseness of the fixing belt 22 and to prevent the fixing belt 22 from floating. Therefore, it is possible to stabilize a rotation track of the fixing belt 22 and to make the heat conducting member 30 more securely come into contact with the fixing belt 22.

Since the slide contact part 51 of the slide contact member 27 comes into slide contact with the inner circumference face of the fixing belt 22, it is possible to reduce a sliding load of the fixing belt 22 during rotation in comparison with a case where the nip member 25 comes into slide contact with the inner circumference face of the fixing belt 22, and accordingly, it is possible to stabilize the rotation of the fixing belt 22.

The attachment part 50 of the slide contact member is interposed between the right side face of the supporting member 26 and the fixed end part 56 of the heat conducting member 30 as well as the right fixed plate 65 of the reflecting member 31. Therefore, it is possible to cut off heat conduction from the heat conducting member 30 and reflecting member 31 to the supporting member 26 and to restrain the temperature rise of the supporting member 26. According to this, it is possible to increase the temperature rise rate of the fixing belt 22, and simultaneously, to restrain the excessive temperature rise (overshoot) of the fixing belt 22 when the rotation of the fixing belt 22 is stopped.

In the embodiment, as shown in FIG. 2, the heater 28 and fixing belt 22 are partitioned by the heat conducting member 30. Therefore, it is possible to prevent the heater 28 from directly heating the grease applied on the inner circumference face of the fixing belt 22 and to restrain quality (heat resistance) of the grease from deteriorating.

The fixing belt 22 is interposed between the curved plate part 64 of the heat conducting member 30 and the thermistor 37. Therefore, it is possible to make the thermistor 37 securely come into contact with the fixing belt 22 and to avoid a situation where the contact between the thermistor 37 and fixing belt 22 is lost and normal control becomes impossible.

Each fixed plate 65 of the reflecting member 31 and the supporting member 26 are separated from each other by the first and second heat insulating spacers 71 and 72. By applying such a configuration, it is possible to improve the heat insulating effect between the reflecting member 31 and supporting member 26.

In the embodiment, the fixed end part 56 of the heat conducting member 30 is arranged at the right side (at the upstream side in the conveying direction of the sheet) of the supporting member 26 and the free end part 57 of the heat conducting member 30 is arranged at the left side (at the downstream side in the conveying direction of the sheet) of the supporting member 26. On the other hand, in another embodiment, the fixed end part 56 of the heat conducting member 30 may be arranged at the left side (at the downstream side in the conveying direction of the sheet) of the supporting member 26 and the free end part 57 of the heat conducting member 30 may be arranged at the right side (at the upstream side in the conveying direction of the sheet) of the supporting member 26.

In the embodiment, the attachment part 50 of the slide contact member 27 is interposed between the supporting member 26 and the heat conducting member 30 as well as the reflecting member 31. On the other hand, in another embodiment, the attachment part 50 of the slide contact member 27 may be interposed between the supporting member 26 and any one of the heat conducting member 30 and reflecting member 31.

Although, in the embodiment, a case of using the halogen heater as the heater 28 was described, in another embodiment, a ceramic heater or the like may be used as the heater 28.

The embodiment was described in a case of applying the configuration of the present disclosure to the printer 1. On the other hand, in another embodiment, the configuration of the disclosure may be applied to another image forming apparatus, such as a copying machine, a facsimile or a multifunction peripheral.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. A fixing device comprising:

a fixing belt arranged rotatably;

a pressure rotating body arranged outside the fixing belt to come into pressure contact with the fixing belt so as to form a fixing nip, and arranged rotatably;

a nip member arranged inside the fixing belt to press the fixing belt toward a side of the pressure rotating body;

a supporting member supporting the nip member;

a heating source arranged inside the fixing belt to emit radiant heat;

a heat conducting member supported by the supporting member in a cantilevered state to come into contact with an inner circumference face of the fixing belt and to absorb the radiant heat emitted from the heating source; and a reflecting member configured to reflect the radiant heat emitted from the heating source toward the heat conducting member and to at least partially come into contact with the heat conducting member.

2. The fixing device according to claim 1, wherein the heat conducting member includes:

a fixed end part arranged at any one of an upstream side and a downstream side of the supporting member in a conveying direction of a recording medium and fixed to the supporting member;

a free end part arranged at another of the upstream side and downstream side of the supporting member in the conveying direction of the recording medium and arranged movably with respect to the supporting member; and a connecting part connecting the fixed end part and free end part, the reflecting member includes:

a pair of fixed plates arranged respectively at the upstream side and downstream side of the supporting member in the conveying direction of the recording medium and fixed to the supporting member; and a connecting plate connecting the pair of the fixed plates, any one of the pair of the fixed plates at least partially comes into contact with the fixed end part.

3. The fixing device according to claim 2, wherein, the free end part has an insertion piece extending to an internal diameter side of the fixing belt, another of the pair of the fixed plates has an insertion hole into which the insertion piece is movably inserted.

4. The fixing device according to claim 2, wherein the connecting part has a curved plate part curved toward a side separating from the fixing nip, the connecting plate is curved toward a side approaching to the fixing nip, the heating source is positioned between the curved plate part and connecting plate.

5. The fixing device according to claim 1, wherein the heat conducting member is made of resilient material.

6. The fixing device according to claim 1, further comprising:

a pair of bearings positioned at both end sides in a rotating axis direction of the fixing belt, wherein the bearing has:

a meander regulating part positioned at the outside in the rotating axis direction of an end part of the fixing belt; and a flange part extending from the meander regulating part to the inside in the rotating axis direction, the end part of the fixing belt is interposed between the heat conducting member and flange part.

7. The fixing device according to claim 1, further comprising:

a slide contact member interposed between the fixing belt and nip member, wherein the slide contact member has;

an attachment part attached to the supporting member; and a slide contact part bent from the attachment part and coming into slide contact with the inner circumference face of the fixing belt, the attachment part is interposed between the supporting member and one or both of the heat conducting member and reflecting member.

8. The fixing device according to claim 7, further comprising:

a first heat insulating spacer interposed between the reflecting member and attachment part.

9. The fixing device according to claim 1, further comprising:

a second heat insulating spacer interposed between the reflecting member and supporting member.

10. The fixing device according to claim 1, wherein the heat conducting member is configured so as to be deformed, when the fixing belt is deformed according to the rotation of the fixing belt, in accordance with a deformation of the fixing belt.

11. An image forming apparatus comprising:

a fixing device, wherein the fixing device includes:

a fixing belt arranged rotatably;

a pressure rotating body arranged outside the fixing belt so as to come into pressure contact with the fixing belt to form a fixing nip, and arranged rotatably;

a nip member arranged inside the fixing belt so as to press the fixing belt toward a side of the pressure rotating body;

a supporting member supporting the nip member;

a heating source arranged inside the fixing belt so as to emit radiant heat;

a heat conducting member supported by the supporting member in a cantilevered state so as to come into contact with an inner circumference face of the fixing belt and to absorb the radiant heat emitted from the heating source; and a reflecting member configured to reflect the radiant heat emitted from the heating source toward the heat conducting member and to at least partially come into contact with the heat conducting member.

12. The image forming apparatus according to claim 11, wherein the heat conducting member includes:

a fixed end part arranged at any one of an upstream side and a downstream side of the supporting member in a conveying direction of a recording medium and fixed to the supporting member;

a free end part arranged at another of the upstream side and downstream side of the supporting member in the conveying direction of the recording medium and arranged movably with respect to the supporting member; and a connecting part connecting the fixed end part and free end part, the reflecting member includes:

a pair of fixed plates arranged respectively at the upstream side and downstream side of the supporting member in the conveying direction of the recording medium and fixed to the supporting member; and a connecting plate connecting the pair of the fixed plates, any one of the pair of the fixed plates at least partially comes into contact with the fixed end part.

13. The image forming apparatus according to claim 12, wherein, the free end part has an insertion piece extending to an internal diameter side of the fixing belt, another of the pair of the fixed plates has an insertion hole into which the insertion piece is movably inserted.

14. The image forming apparatus according to claim 12, wherein the connecting part has a curved plate part curved toward a side separating from the fixing nip, the connecting plate is curved toward a side approaching to the fixing nip, the heating source is positioned between the curved plate part and connecting plate.

15. The image forming apparatus according to claim 11, wherein the heat conducting member is made of resilient material.

16. The image forming apparatus according to claim 1, wherein the fixing device further includes:

a pair of bearings positioned at both end sides in a rotating axis direction of the fixing belt, wherein the bearing has:

a meander regulating part positioned at the outside in the rotating axis direction of an end part of the fixing belt; and a flange part extending from the meander regulating part to the inside in the rotating axis direction, the end part of the fixing belt is interposed between the heat conducting member and flange part.

17. The image forming apparatus according to claim 11, wherein the fixing device further includes:

a slide contact member interposed between the fixing belt and nip member, wherein the slide contact member has;

an attachment part attached to the supporting member; and a slide contact part bent from the attachment part and coming into slide contact with the inner circumference face of the fixing belt, the attachment part is interposed between the supporting member and one or both of the heat conducting member and reflecting member.

18. The image forming apparatus according to claim 17, wherein the fixing device further includes:

a first heat insulating spacer interposed between the reflecting member and attachment part.

19. The image forming apparatus according to claim 11, wherein the fixing device further includes:

a second heat insulating spacer interposed between the reflecting member and supporting member.

20. The image forming apparatus according to claim 11, wherein the heat conducting member is configured so as to be deformed, when the fixing belt is deformed according to the rotation of the fixing belt, in accordance with a deformation of the fixing belt.

* * * * *